US005996445A

United States Patent [19]

Wiens et al.

[11] Patent Number: 5,996,445

[45] Date of Patent: Dec. 7, 1999

[54] RATCHETING WRENCH

[75] Inventors: Benjamin Isaac Wiens, Coquitlam; Anthony Anil Fonseka, Port Coquitlam; Randall R. Somerville, Pitt Meadows, all of Canada

[73] Assignee: Universal Toolcraft Corporation, Port Coquitlam, Canada

[21] Appl. No.: 09/090,377

[22] Filed: Jun. 4, 1998

[51] Int. Cl.[6] ..... B25B 13/28

[52] U.S. Cl. ..... 81/111; 81/99

[58] Field of Search ..... 81/99, 111, 186

[56] References Cited

U.S. PATENT DOCUMENTS

| | | |
|---|---|---|
| 743,019 | 11/1903 | Nelson . |
| 749,134 | 1/1904 | Hyman . |
| 770,574 | 9/1904 | Halstead et al. . |
| 1,015,504 | 1/1912 | Meyer . |
| 1,050,215 | 1/1913 | Hesse . |
| 1,068,771 | 7/1913 | Holmes . |
| 1,072,090 | 9/1913 | Cook . |
| 1,183,371 | 5/1916 | Ginsburg . |
| 1,369,459 | 2/1921 | Miskimen . |
| 1,466,136 | 8/1923 | Matthews . |
| 1,635,930 | 7/1927 | Forsdahl . |
| 2,000,744 | 5/1935 | Davies . |
| 2,277,400 | 3/1942 | Hewitt et al. . |
| 2,618,996 | 11/1952 | Logan . |
| 2,655,064 | 10/1953 | Simon et al. . |
| 2,846,912 | 8/1958 | Day . |
| 3,309,949 | 3/1967 | Neff . |
| 3,641,847 | 2/1972 | Horton . |
| 3,695,125 | 10/1972 | Glass et al. . |
| 3,741,047 | 6/1973 | Kanowsky . |
| 3,803,954 | 4/1974 | Lenker . |
| 3,878,741 | 4/1975 | Wilson . |

(List continued on next page.)

FOREIGN PATENT DOCUMENTS

| | | |
|---|---|---|
| 196295 | 1/1920 | Canada . |
| 271730 | 6/1927 | Canada . |
| 304076 | 9/1930 | Canada . |
| 519086 | 12/1953 | Canada . |
| 523081 | 3/1956 | Canada . |
| 610697 | 12/1960 | Canada . |
| 618316 | 11/1961 | Canada . |
| 662454 | 5/1963 | Canada . |
| 743738 | 10/1966 | Canada . |
| 850359 | 9/1970 | Canada . |
| 1004514 | 2/1977 | Canada . |
| 1022782 | 12/1977 | Canada . |
| 1227958 | 10/1987 | Canada . |
| 1297322 | 6/1989 | Canada . |
| 1261655 | 9/1989 | Canada . |
| 2069265 | 5/1992 | Canada . |
| 125 | 11/1909 | United Kingdom . |

OTHER PUBLICATIONS

Popular Science Magazine, Jun. 1997, p. 24.

Snap–On Incorporated Catalogue, 75th Anniversary Edition, Jan. 1995, p. 122, Snap–On Incorporated, Kenosha, Wisconsin.

*Primary Examiner*—James G. Smith

*Attorney, Agent, or Firm*—Oyen Wiggs Green & Mutala

[57] ABSTRACT

A ratcheting open-ended wrench has a movable jaw pivotally attached to a fixed jaw. The jaws define an opening capable of receiving the hexagonal head of a fastener such as a nut, bolt, hose fitting or pipe fitting. The fastener may be turned by moving the handle of the wrench back and forth without disengaging the fastener from the opening. A stop prevents the movable jaw from moving in a way which would place excessive stresses on the movable jaw. An arc shaped bearing surface on the movable jaw is received in a mating bearing surface on the fixed jaw. The combination of the stop and the mating bearing surfaces greatly reduces shear forces on the pivot. The point about which the movable jaw pivots is located forwardly relative to the opening. A wrench according to the invention can be both strong and compact. The wrench is reliable simple to manufacture and may be made with only three or four parts.

37 Claims, 8 Drawing Sheets

U.S. PATENT DOCUMENTS

| | | |
|---|---|---|
| 3,901,106 | 8/1975 | Causey . |
| 3,921,474 | 11/1975 | Dyck et al. . |
| 4,065,986 | 1/1978 | Meggs et al. . |
| 4,204,440 | 5/1980 | Del Prete et al. . |
| 4,276,790 | 7/1981 | Davis . |
| 4,324,159 | 4/1982 | Wrobbel . |
| 4,485,702 | 12/1984 | Swan et al. . |
| 4,554,847 | 11/1985 | DeSantis . |
| 4,584,913 | 4/1986 | Logan . |
| 4,718,315 | 1/1988 | Nitschmann . |
| 4,825,731 | 5/1989 | Stojanowski . |
| 4,848,193 | 7/1989 | Wylie, III . |
| 5,018,412 | 5/1991 | Wylie, III . |
| 5,131,300 | 7/1992 | Daniel . |
| 5,148,725 | 9/1992 | Botha . |
| 5,381,710 | 1/1995 | Baker . |
| 5,582,082 | 12/1996 | Gajo . |

RATCHETING WRENCH

FIELD OF THE INVENTION

This invention relates to wrenches. More particularly, the invention relates to open-ended wrenches having heads which provide a ratchet-like action so that a fastener may be turned without disengaging the wrench from the head of the fastener.

BACKGROUND OF THE INVENTION

The prior art includes numerous different designs for open-ended wrenches capable of working with a ratcheting action. All of the prior art wrenches known to the inventors have one or more significant defects which limit their usefulness and have prevented their widespread adoption. A particular disadvantage of many prior ratcheting open-ended wrenches is that they are bulky. This makes them incapable of being used in tight quarters. SAE has defined an envelope within which open-ended wrenches should fit. The SAE envelope is described in the SAE Aeronautical Drafting Manual, and in *Machinery's Handbook 23rd Edition*, Industrial Press Inc., N.Y., N.Y., 1988 at page 1299.

In most cases it is impossible to make bulky prior art ratcheting open-ended wrenches compact enough to comply with the SAE specifications without rendering them too weak to use reliably. There is a need for simple effective ratcheting open-ended wrenches which are sufficiently compact to comply with the SAE specifications for open-ended wrenches.

The prior art open-ended ratcheting wrenches also suffer from other disadvantages. Some designs are very complicated. Wrenches according to these designs are undesirable because they have many parts which can fail and are also expensive to make. Other prior wrenches are not sufficiently robust to turn a fastener with sufficient torque. Other prior art wrenches are awkward to engage with the head of a fastener. Other prior art wrenches will not properly grip fasteners which have rounded corners. Some prior art wrenches will slip on a fastener unless the fastener is completely bottomed in the wrench opening.

Prior inventors have struggled to provide open ended ratcheting wrenches having fine ratchet increments such as 45 degrees, 30 degrees, or even 15 degrees. A fine ratchet increment can allow fastener drive heads to be turned in tight quarters. However, in the quest for fine ratchet increments the designers of such previous wrenches have sacrificed simplicity, durability and usability. Most prior art wrenches which have a fine ratchet increment cannot be used reliably to turn fastener heads which have rounded corners. Furthermore, most such wrenches cannot be used effectively unless they are held perpendicular to the axis of rotation of the drive head being turned.

Some prior art ratcheting wrenches have no moving parts at all. These wrenches suffer from the disadvantage that they do not work well on fasteners with rounded corners. These wrenches must have one very short jaw. Consequently they can be used effectively only when a fastener is fully bottomed in the wrench opening.

Gajo, U.S. Pat. No. 5,582,082 shows a ratcheting open ended wrench having a moving jaw which both slides and pivots. This wrench is not as durable as would be desirable. The sliding action of the movable jaw can result in excessive wear. Furthermore, the movable jaw can become permanently deformed if the wrench is used aggressively. The Gajo design requires slots in the jaw which create areas of weakness.

There are a large number of prior wrenches capable of operating with a ratcheting action which include an opening defined by a movable jaw pivotally attached to a fixed jaw. In many of these wrenches, and in contrast to the wrench of this invention, the movable jaw rotates about a pivot point located on the same side of the opening as the gripping surfaces of the movable jaw. Some examples of such wrenches are Hewitt et al, U.S. Pat. No. 2,277,400; Hesse, U.S. Pat. No. 1,050,215; Halstead et al, U.S. Pat. No. 770,574; U.S. Pat. No. 4,324,159; Wylie, U.S. Pat. No. 5,018,412; Page, Canadian patent No. 271,730; De Santis, U.S. Pat. No. 4,554,847; and Meyer, U.S. Pat. No. 1,015,504.

There are a large number of prior ratchet type wrenches having two independently movable jaws. These wrenches are generally undesirably complicated and are therefore expensive to make. Furthermore, they have numerous parts which can wear out. some examples of such wrenches are disclosed in Bartlett, Canadian patent No. 519,086; Dyck, Canadian patent Nos. 850,359 and 1,004,514; Dyck et al., U.S. Pat. No. 3,921,474; Ginsburg, U.S. Pat. No. 1,183,371; Wilson, U.S. Pat. No. 3,878,741; Meggs et al., U.S. Pat. No. 4,065,986; Logan, U.S. Pat. No. 4,584,913; and Nitschmann, U.S. Pat. No. 4,718,315.

Despite the wide variety of ratcheting open ended wrenches described in the prior art there remains a need for a compact open ended wrench which is capable of providing a ratcheting action and yet improves on the capabilities of prior art wrenches.

SUMMARY OF THE INVENTION

This invention provides a ratcheting wrench for turning hexagonal drive heads such as the heads of bolts, nuts, pipe fittings, flare nuts, or other fasteners. The wrench comprises a handle having first and second ends. A fixed jaw projects forwardly from the first end of the handle. A movable jaw is pivotally attached to the handle. The movable jaw is pivotally movable relative to the fixed jaw about a pivot axis. The fixed and movable jaws define an opening between themselves. A hexagonal drive head can be received in the opening between first and second nut-contacting surfaces on the fixed and movable jaws respectively. The first and second nut-contacting surfaces are generally parallel when the movable jaw is in a first position. A stop member is located on the fixed jaw. A rearward face on the stop member provides an elongated stop surface located to block the movable jaw from pivoting past the first position toward the fixed jaw. A forward face on the stop member provides a backstop for blocking a drive head from being inserted into the opening past the backstop. The wrench also comprises bias means disposed between the handle and the movable jaw for biasing the movable jaw toward the fixed jaw. The first and second nut-contacting surfaces are spaced apart by a distance D when in the first position. The pivot axis is located on a side of the first nut-contacting surface away from the movable jaw and is located forwardly of a rear edge of the first nut contacting surface by a distance of at least 0.17×D.

Preferably the first nut-contacting surface has a recessed inside portion. The recessed portion extends from the backstop along the first nut-contacting surface for a distance of at least 0.35×D and most preferably for a distance of at least 0.39×D. Most preferably the recessed portion has a concave arcuate contour.

In some preferred embodiments the movable jaw comprises a pair of side plates separated by a slot and the slot receives a web portion connecting the handle and the fixed jaw.

A flare-nut style wrench may be made according to the invention. In flare nut style wrenches according to the invention the fixed jaw comprises an extension projecting outwardly from the outer end of the first surface. The extension bears an additional surface inclined at an angle of 60 degrees to the first surface and a second recessed portion between the first and additional surfaces. A portion of the backstop is recessed to permit back-rotation of a drive head in the opening. Preferably the backstop comprises a flat surface adjacent the second recessed portion. The flat surface is disposed at an angle of 60 degrees to the first surface and can assist in driving a drive head engaged in the opening of the wrench. Most preferably the stop surface and the backstop are substantially coextensive.

BRIEF DESCRIPTION OF THE DRAWINGS

In drawings which illustrate specific embodiments of the invention, but which should not be construed as restricting the spirit or scope of the invention in any way.

DETAILED DESCRIPTION

Figure 13:
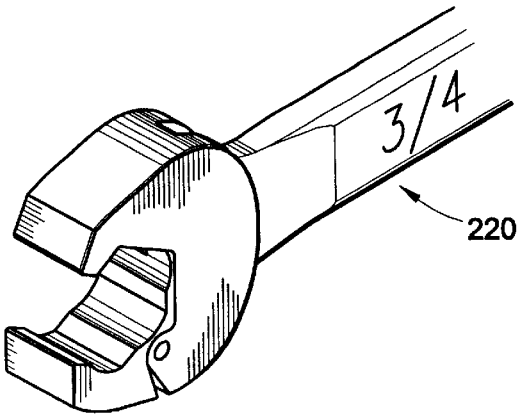
FIG. 13 is an isometric view of the ratcheting head end of a flare-nut type wrench according to the invention.
Figure 14:
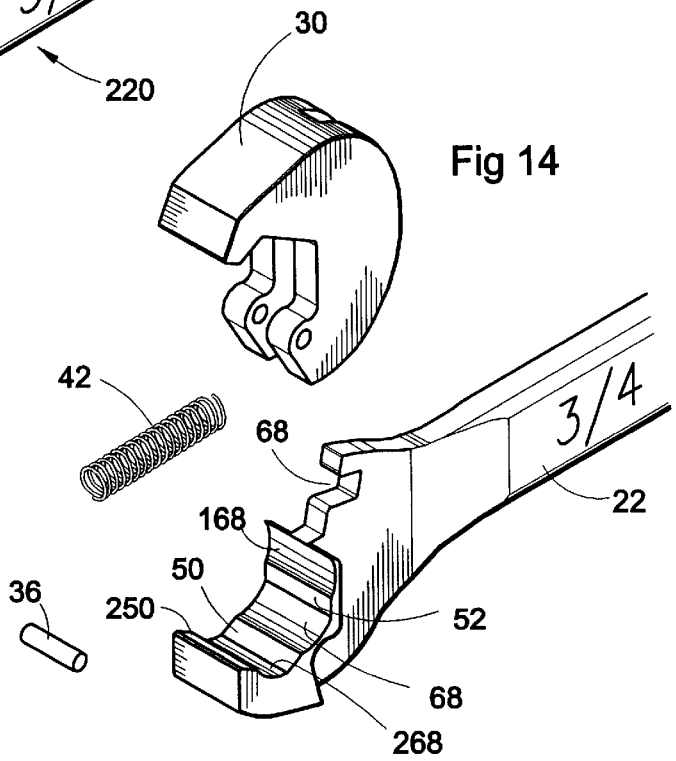
FIG. 14 is an exploded view of the ratcheting head of the wrench of FIG. 13; and, FIG. 15 is a side elevational view of the ratcheting head of the flare-nut wrench of FIG. 13.
Figure 15:
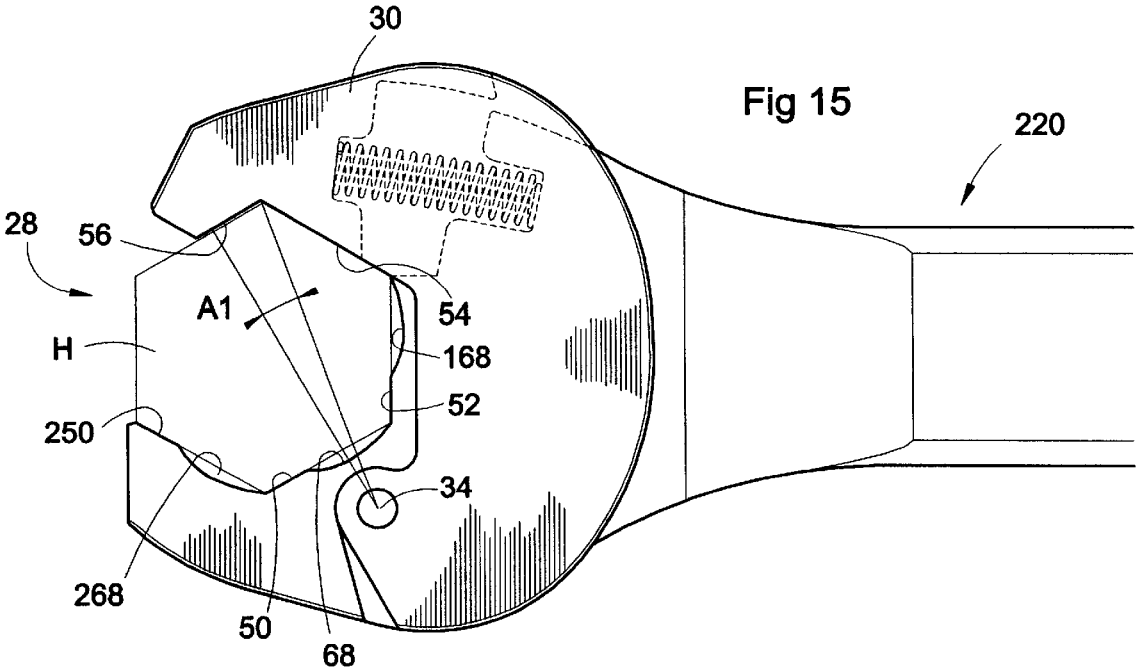

This invention provides ratcheting wrenches for turning drive heads, such as the hexagonal heads of nut, bolts, pipe fittings and the like. Wrenches according to the invention may be made in different forms. For example, open ended spanner-type wrenches according to some embodiments of the invention are illustrated in FIGS. 1 through 12. A flare nut style wrench according to an alternative embodiment of the invention is illustrated in FIGS. 13 through 15.

Figure 1:
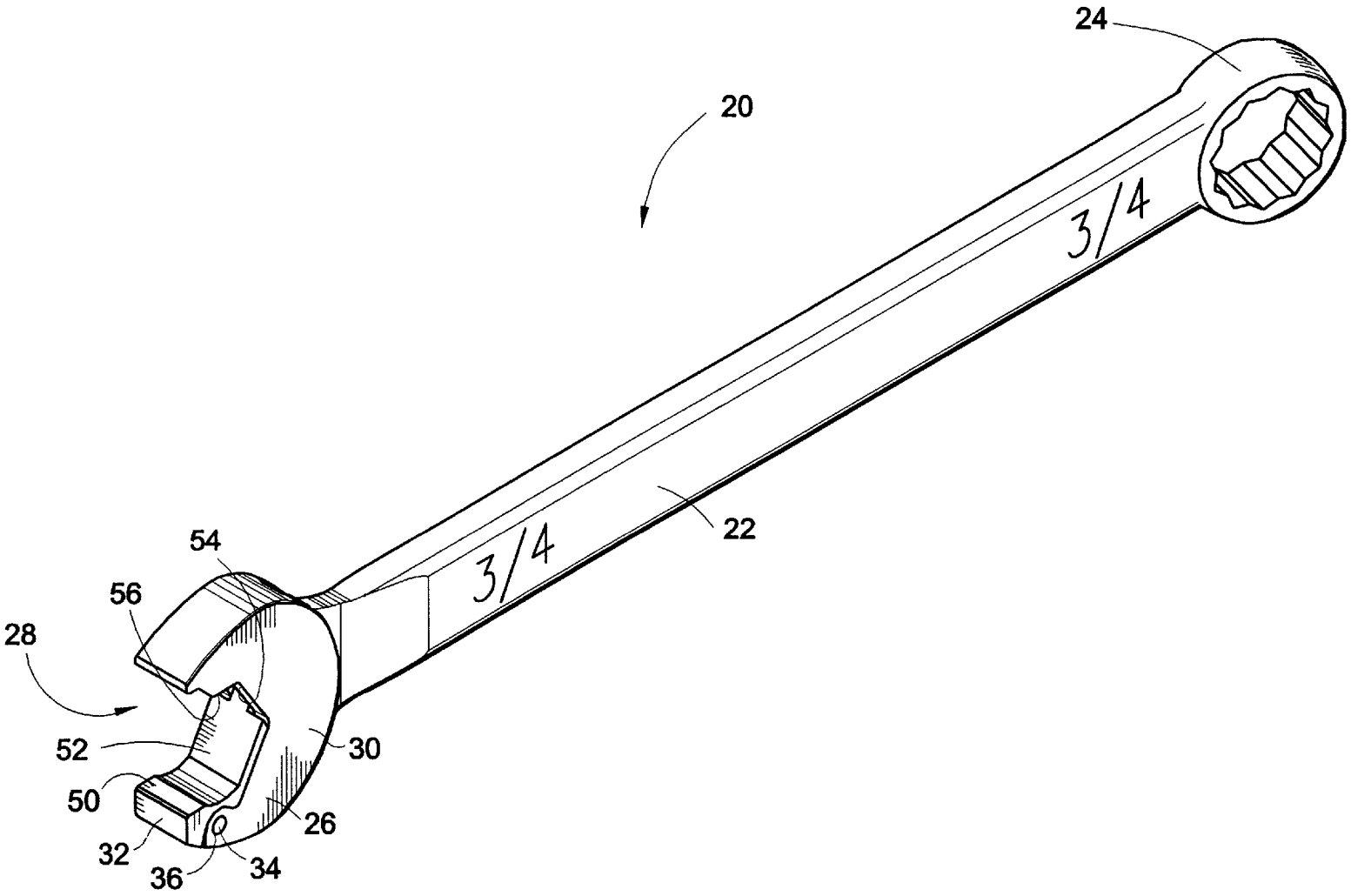
FIG. 1 is an isometric view of an open-ended ratcheting wrench according to the invention.

FIG. 1 shows a spanner type wrench 20 according to the invention. Wrench 20 has a handle 22, a conventional box end wrench 24 on one end of the handle, and a ratcheting open-ended head 26 according to the invention at the opposite end of handle 22. Handle 22 is preferably reasonably thick so that it is comfortable to hold and reasonably long so that a user can apply torque to a drive head being turned by wrench 20 without excessive effort.

Head 26 defines an opening 28 for receiving drive heads such as the heads of nuts, bolts or other fasteners equipped with suitably dimensioned hexagonal heads. Head 26 permits a fastener to be turned through a large angle without disengaging the fastener from opening 28.

Preferably, opening 28 is symmetrical about a line which is parallel to the axis of handle 22. That is, head 26 preferably permits opening 28 to be engaged with a fastener head by moving wrench 20 in a direction parallel to the axis of handle 22. This type of insertion is called "inline" insertion. Inline insertion is desirable because it makes wrench 20 easier to use.

When a wrench 20 is used to turn a fastener drive head then the direction of rotation of the fastener drive head can be reversed by simply flipping the wrench 20 about its longitudinal axis. If the wrench is configured for inline insertion then opening 28 will automatically be oriented properly to receive the fastener drive head, without changing the orientation of the axis of handle 22, when the wrench 20 is flipped. Some prior art wrenches are designed in a way which does not permit inline insertion and which does not permit modification for inline insertion. Those skilled in the art will realize that while an inline insertion configuration is highly desirable, the angle of opening 28 relative to handle 22 in a wrench according to the invention may be varied without affecting the ratcheting action of head 26.

Head 26 has a movable jaw 30 which is pivotally affixed to a fixed jaw 32. Movable jaw 30 can pivot about a pivot axis 34. Pivot axis 34 is defined, for example, by a pivot pin 36 which passes through holes in movable jaw 30 and fixed jaw 32. A rivet, screw, press-in pin, or the like could be used for pivot pin 36.

Fixed jaw 32 provides two nut-contacting surfaces 50, 52 (FIG. 5) for bearing against two surfaces of the hexagonal drive head H of a fastener. Nut contacting surface 50 may be termed a "first surface". Nut contacting surface 52 may be termed a "backstop". Nut-contacting surface 52 preferably includes a flat surface capable of bearing against a face of a drive head to help to grip and turn the drive head. Most preferably, nut-contacting surface 52 comprises a flat surface extending between nut-contacting surface 54 and recess 68 on nut-contacting surface 50.

Nut contacting surfaces 50 and 52 are disposed at an angle of 60 degrees to one another. Movable jaw 30 defines two additional nut contacting surfaces 54, 56 each also capable of bearing against faces of the hexagonal drive head H. Nut contacting surface 56 may be called a "second surface". Nut contacting surface 54 may be called a "third surface". Nut contacting surfaces 54 and 56 are disposed at an angle of 60 degrees to one another. Each of the nut contacting surfaces may be smooth, as illustrated, or may be serrated or otherwise textured to better grip a drive head. Opening 28 has an internal shape that generally follows 3½ sides of a regular hexagon when movable jaw 30 is in its "closed" position, as defined below.

Nut contacting surfaces 54, 56 on movable jaw 30 are on the opposite side of opening 28 from pivot axis 34. This distinguishes wrenches according to this invention from wrenches of the type in which a movable jaw is pivoted on the same side of the opening as nut-contacting surfaces on the movable jaw.

Figure 2:
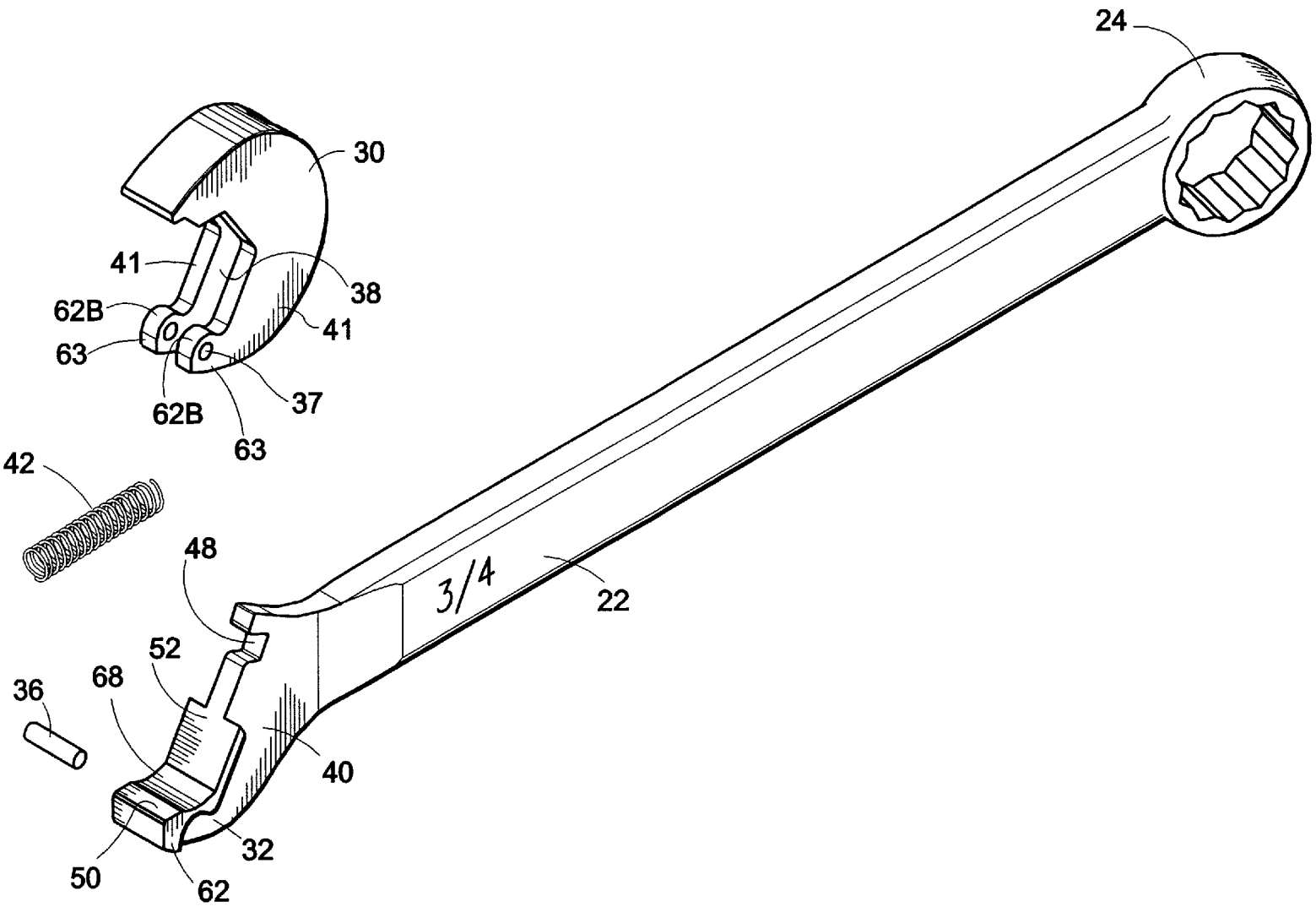
FIG. 2 is an exploded isometric view thereof.

As shown in FIG. 2, movable jaw 30 preferably comprises a pair of side plates 41 separated by a slot 38. Slot 38 receives the web 40 which connects fixed jaw 32 to handle 22. This arrangement provides a strong movable jaw 30 and prevents movable jaw 30 from twisting as torque is applied using ratchet head 26. Pivot pin 36 passes through holes 37 in side plates 41 and web 40. Movable jaw 30 is preferably fabricated in one piece but may comprise several pieces fastened together without departing from the invention. Movable jaw 30 should be strong so that it does not stretch significantly or become otherwise deformed during use.

Figure 3:
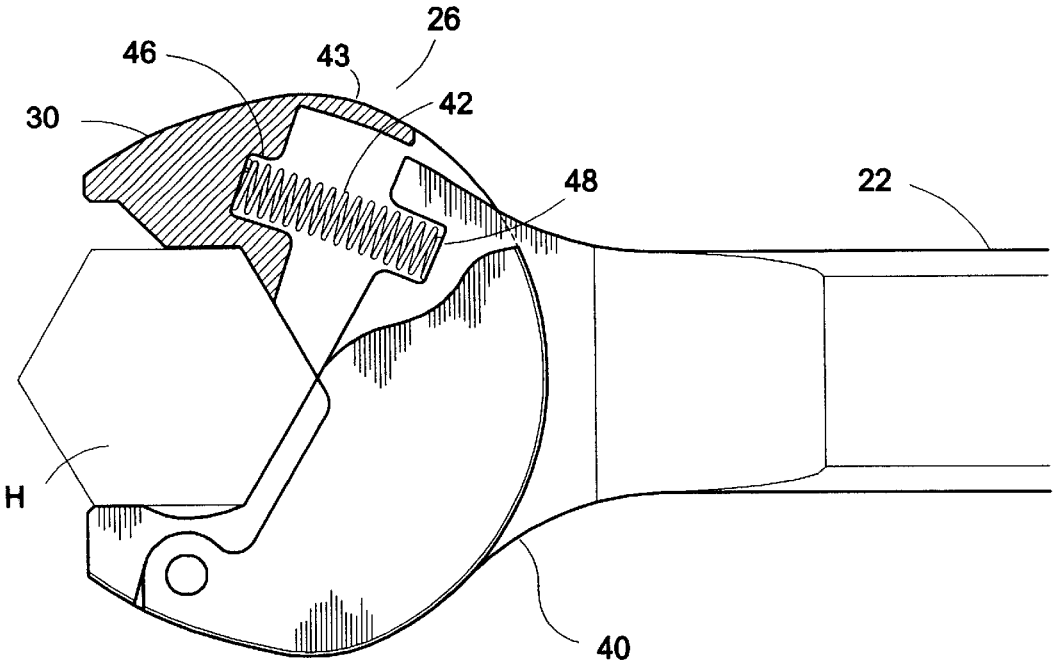
FIG. 3 is a longitudinal elevational sectional view through the ratcheting head portion thereof.

As shown in FIG. 3, a spring 42 extends between movable jaw 30 and web 40 so that movable jaw 30 is biased to pivot away from handle 22 (i.e. movable jaw is biased to pivot in a counterclockwise direction when viewed as in FIG. 3). Spring 42 is a compression spring having first and second ends received in a cavity 46 in movable jaw 30 and a recess 48 in web 40 respectively. Spring 42 lies within slot 38 and is therefore protected by side plates 41. A shutter portion 43 of movable jaw 30 is preferably provided to block dirt from entering the area around spring 42 from the outside end of slot 38.

Spring 42 is located well away from pivot axis 34. One advantage of this configuration is that a relatively light weight, spring 42 with a low spring constant can provide sufficient force to bias movable jaw 30 toward its "closed" position. A second advantage of this configuration is that recess 48 is located in a position where it does not unnecessarily weaken handle 22. Cavity 46 and recess 48 are preferably angled slightly so that spring 42 forms an arc, as shown. This helps to prevent spring 42 from rubbing excessively on side plates 41 and avoids jamming. The ends of spring 42 should be squared off so that spring 42 sits squarely in cavity 46 and recess 48.

Figure 4:
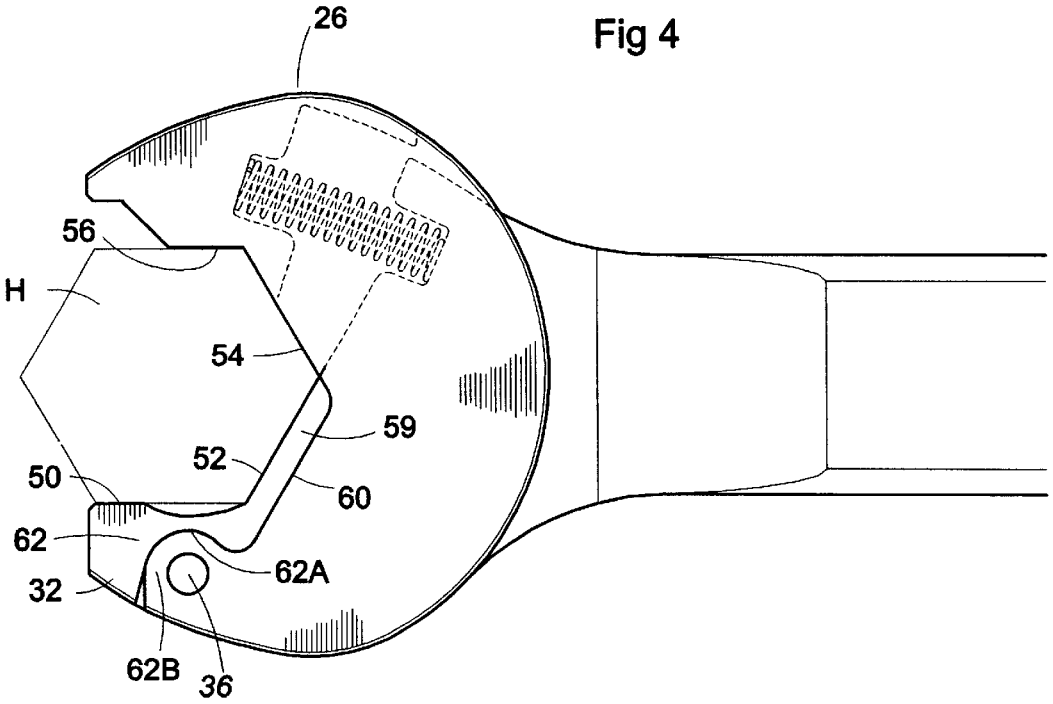
FIG. 4 is a side elevational view of the ratcheting head portion thereof.

As shown in FIG. 4, the portion of fixed jaw 32 adjacent nut contacting surface 52 defines an elongated, generally straight, stop member 59 which provides a pair of stop surfaces 60 on its rear side. One stop surface 60 projects outwardly on each side of web 40. Spring 42 biases movable jaw 30 into a "closed" position in which forward surfaces of plates 41 bear against stop surfaces 60. When movable jaw 30 is in its closed position nut contacting surfaces 52 and 54 are disposed at an angle of 60 degrees to one another and stop surfaces 60 prevent movable jaw 30 from rotating to further close opening 28. If wrench 20 had no stop surfaces to prevent movable jaw 30 from closing too far then great forces would be applied to movable jaw 30 because of the close spacing between pivot axis 34 and the portion of nut contacting surface 50 which bear against a drive head being turned by wrench 20. The handle then acts as a long lever arm which delivers forces to movable jaw 30 through a very short lever arm. The resulting leverage could cause tremendous stresses in movable jaw 30 while wrench 20 is in use.

As described below, substantial forces are applied to stop surfaces 60 when a fastener is being tightened. Providing extended stop surfaces 60, which bear against the forward surfaces of plates 41, distributes these forces over the extended regions in which plates 41 contact stop surfaces 60. Preferably stop surfaces 60 are substantially coextensive with nut contacting surface 52 as illustrated in FIG. 4. This prevents excessive contact pressures which could wear or damage stop surfaces 60 or side plates 41. Movable jaw 30 is readily able to bear forces applied to the forward surfaces of plates 41. These factors increase the ability of ratcheting head 26 to deliver large torques to fasteners without becoming damaged.

A portion 62 of fixed jaw 32 adjacent nut contacting surface 50 projects outwardly on each side from web 40. Portion 62 provides a concave arc-shaped face 62A on each side of web 40. Faces 62A each follow arcs centered on pivot axis 34. Faces 62A matingly receive arc-shaped faces 62B of ear portions 63 of plates 41. The mating of faces 62B with faces 62A prevents excessive shearing forces from being applied to pivot pin 36 when wrench 20 is in use.

During tightening, drive head H exerts great forces which tend to separate fixed jaw 32 and movable jaw 30. These forces would be applied to pivot pin 36 if it were not for mating faces 62A and 62B (FIG. 4). While torque is being applied to drive head H faces 62B bear against faces 62A. Mating faces 62A and 62B transmit these forces directly from movable jaw 30 to fixed jaw 32. The arcuate shape of surfaces 62A and 62B does not interfere with the ability of movable jaw 30 to pivot relative to fixed jaw 32.

The strength of pivot pin 36 could be increased by increasing the diameter of pivot pin 36. However, if wrench 20 is configured for inline operation then increasing the diameter of pivot pin 36 would unacceptably increase the bulk of wrench 20 so that wrench 20 could no longer fall within the envelope set by the above-noted SAE standards. Most preferably, the wrench is constructed with a shape which conforms with SAE wrench specifications. In general, a smaller and more compact open-ended wrench is better than a larger more bulky wrench because it allows the wrench to be operated in tighter quarters than would be possible with a bulkier wrench.

Figure 5:
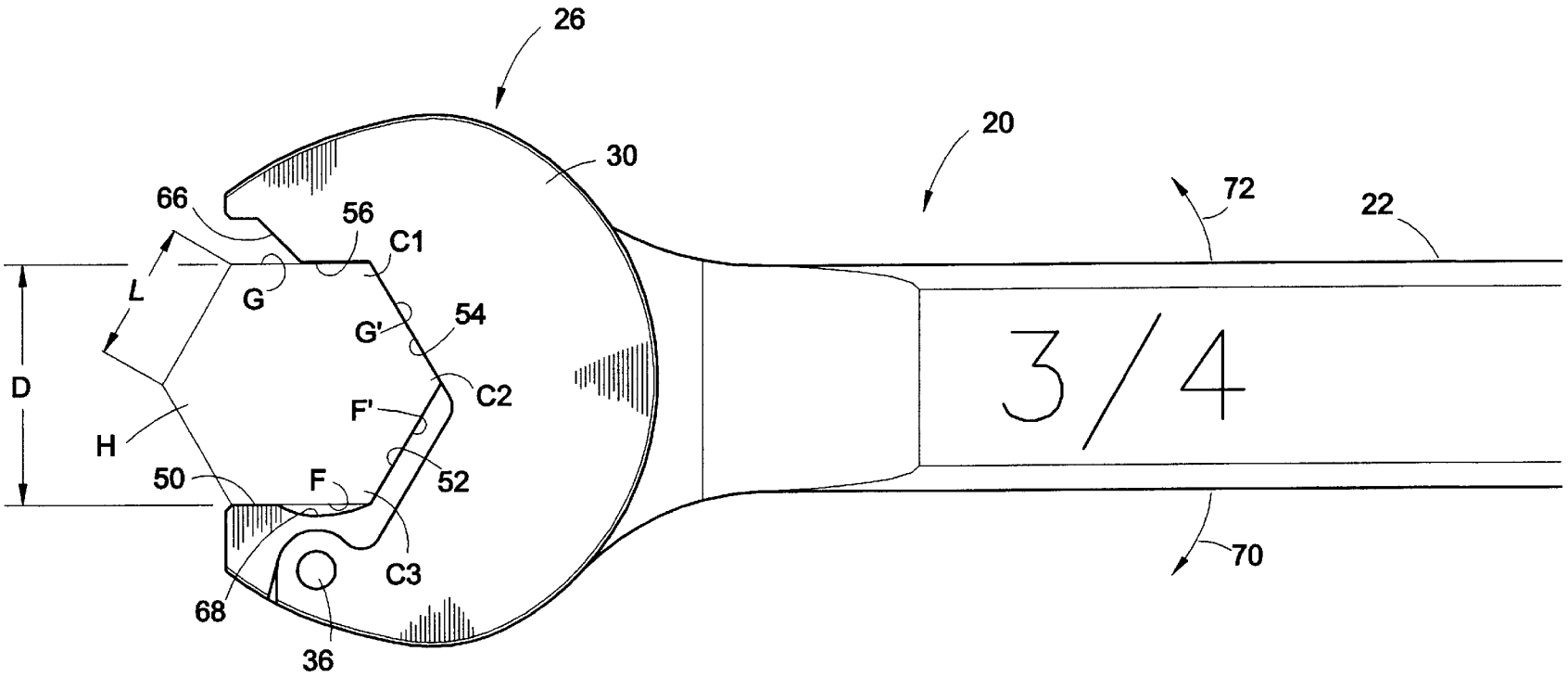
FIG. 5 is a side elevational view of the ratcheting head portion thereof engaging the head of a fastener.

FIG. 5 shows wrench 20 placed so that opening 28 receives a hexagonal drive head H, such as the head of a bolt, nut or the like. Drive head H has four faces F, G, F' and G' which respectively contact nut contacting surfaces 50, 56, 52 and 54 of ratcheting head 26.

The size of drive head H which can be turned with ratcheting head 26 is determined by the distance D between nut contacting surfaces 50 and 56. Surfaces 50 and 56 are spaced to slidingly receive parallel flats F and G of a hexagonal drive head H. Simple geometry shows that the length L of one side of a hexagonal drive head H having a size so that it can be snugly received between nut contacting surfaces 50 and 56 is related to D by the formula:

$$L = \frac{D}{2 \times \sin(60°)} \approx \frac{D}{1.73} \tag{1}$$

A wrench 20 may be provided in a range of sizes corresponding to various sizes of standard fastener heads.

The depth of insertion of drive head H into opening 28 is limited by nut contacting surface 52, which acts as a backstop. Nut contacting surface or "backstop" 52 bears against face F' of drive head H when drive head H is fully inserted in opening 28 as shown in FIG. 5.

The tip of movable jaw 30 adjacent nut contacting surface 56 is cut away as compared to the tip of the conventional open-ended spanner wrench. Preferably an angled surface 66 extends past the outer end of nut-contacting surface 56. Surface 66 helps to guide opening 28 onto a drive head H but is recessed sufficiently that it does not interfere with the ratcheting action of ratcheting head 26.

The outer end of nut-contacting surface 56 of movable jaw 30 is most preferably about 50% of the way along the flat G of drive head H which is adjacent to nut-contacting surface 56 when drive head H is fully received in opening 28. That is, when a hexagonal drive head having opposed flats of length L spaced apart by a distance equal to D is fully engaged in opening 28 then the outermost end of the nut-contacting surface 56 is at a midpoint of flat G. In other words, the length L2 (FIG. 8) of nut-contacting surface 56, as measured from the position of corner C1 of a fully inserted, properly sized drive head H, is preferably about 0.5×L (0.29×D). A length longer than this is not desirable as it could interfere with back rotation. A shorter length is not desirable because the tendency of wrench 20 to slip on a drive head H increases as the length of nut-contacting surface 56 is reduced. The tendency for a wrench with a very short nut-contacting surface 56 to slip is especially pronounced for drive heads H, such as worn bolts, which have rounded corners.

Nut contacting surface 50 of fixed jaw 32 has a recess or "undercut" 68 in the inner portion of its face. Recess 68 is most preferably arcuate, as shown, and most preferably extends a distance L1 (FIG. 8) of 0.67×L (i.e. about 0.387×D) from the intersection of nut contacting surfaces 50 and 52 (e.g. from the position of corner C3 of a fully inserted, properly sized drive head H) along the flat F of fastener drive head H. Preferably distance L1 is at least 0.35×D and more preferably L1 is more than about 0.38×D. If L1 is significantly more than 0.39×D then the ability of wrench 20 to grip a drive head H is reduced. This is particularly true if the drive head has rounded corners. If L1 is reduced too far below its optimum value then smooth back rotation will be impeded. If L1 is further reduced then a drive head H will bind in opening 28 during back rotation.

Recess 68 is deep enough to allow a drive head H to turn slightly in opening 28 during back rotation, as described below. Recess 68 should slope gently enough into nut contacting surface 50 that the corner of a drive head will not grab in recess 68 during counter rotation.

The overall length of nut contacting surface 50, as measured from corner C3 of drive head H (FIG. 5) is preferably not significantly longer than L (D÷1.73). If nut-contacting surface 50 were much longer than L, wrench 20 could not be operated at an elevated angle and still ratchet properly. The overall length of nut-contacting surface 50 should not be significantly shorter than L (D÷1.73) or wrench 20 will not be able to tightly engage drive head H.

When handle 22 is moved in the direction indicated by arrow 70, fastener drive head H is turned clockwise (as shown in FIG. 5) by the forces applied by nut contacting surfaces 50–56. As this is happening, the forces acting on movable jaw 30 tend to pull and hold movable jaw 30 into firm contact with stop surfaces 60. As long as handle 22 is being forced in the direction of arrow 70, head 26 operates in substantially the same manner as a conventional non-ratcheting open-ended spanner wrench.

Figure 6:
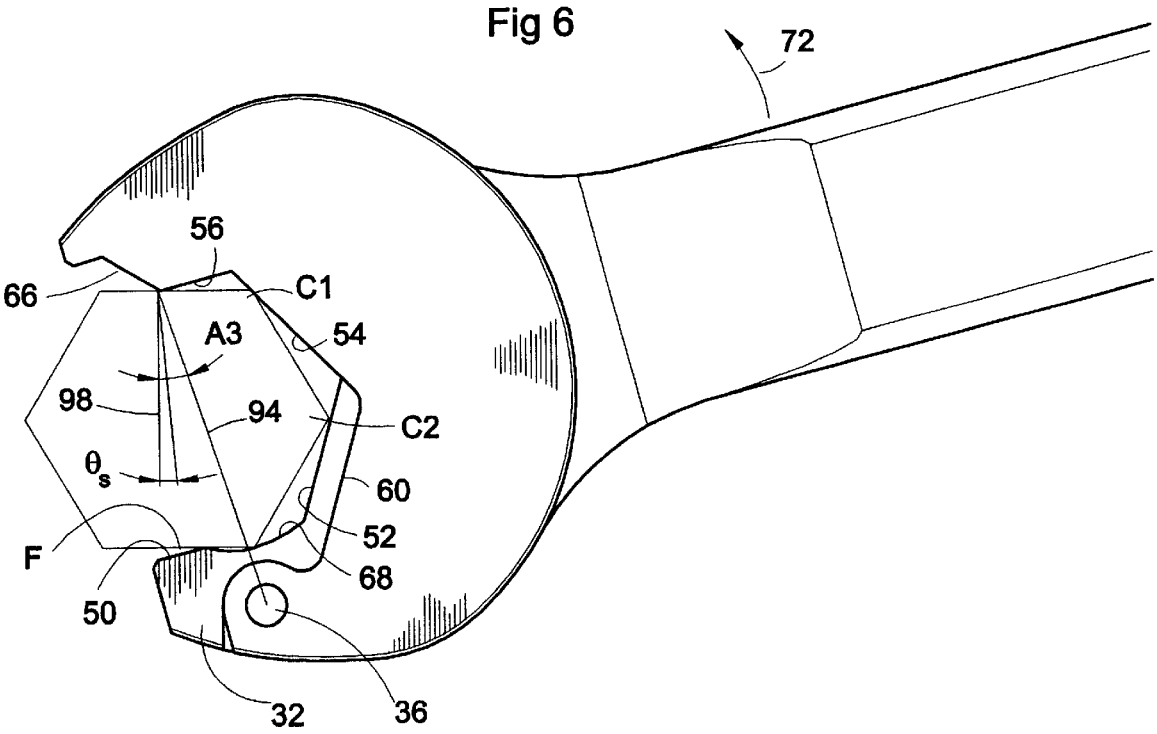
FIG. 6 is a side elevational view of the ratcheting head portion thereof during the first few degrees of back rotation.
Figure 7:
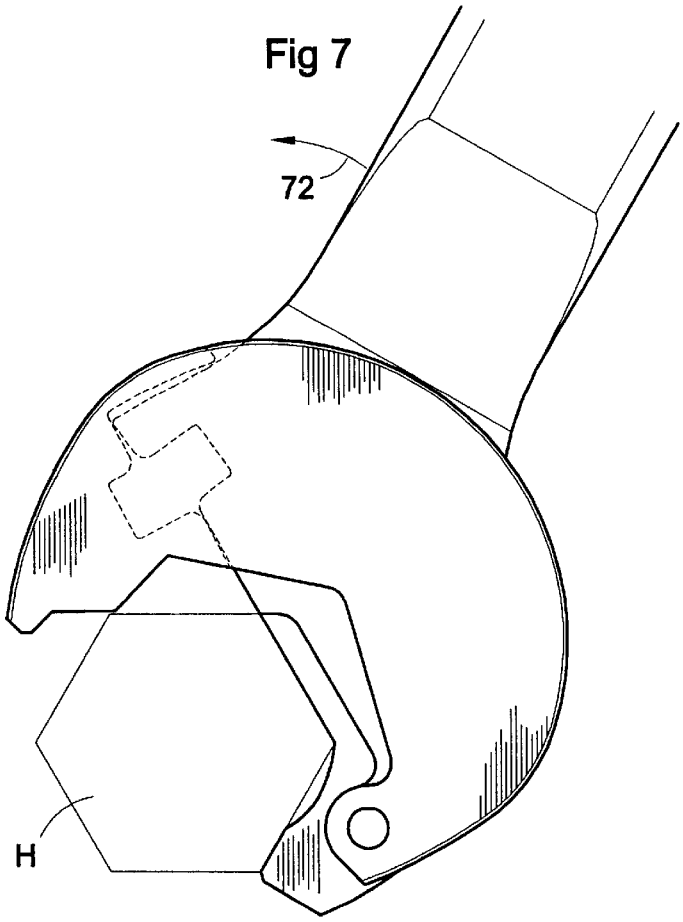
FIG. 7 is a side elevational view of the ratcheting head portion thereof toward the completion of back rotation.

When handle 22 is moved in the direction of arrow 72 then corner C3 of drive head H can drop into recessed area 68 to allow ratcheting head 26 to counter rotate with respect to drive head H. As shown in FIG. 6, recess 68 is deep enough to allow ratcheting head 26 to counter rotate significantly in opening 28 while movable jaw 30 remains in its "closed" position against stop surfaces 60. When ratcheting head 26 is rotated past the position shown in FIG. 6 then movable jaw 30 begins to open against the bias forces exerted by spring 42. The precise angle of back rotation at which movable jaw 30 begins to open depends upon the length of nut-contacting surface 56, the geometry of recess 68 and the geometry of nut-contacting surface 52. Eventually movable jaw 30 pivots until opening 28 is large enough to slip around head H as shown in FIG. 7.

During back rotation, corner C2 of drive head H rides against nut contacting surface 52. This tends to move drive head H outwardly in opening 28. Nut-contacting surface or "backstop" 52 prevents drive head H from moving deeper into opening 28 into a position where it could jam against movable jaw 30.

Finally, after handle 22 has been moved in the direction of arrow 72 through an angle of approximately 60 degrees, movable jaw 30 is once again in a position relative to drive head H where spring 42 can bias it toward its closed position against stop surfaces 60. Therefore, by alternately moving handle 22 in the directions of arrows 70 and 72, drive head H may be rotated in a clockwise direction (as shown in FIG. 5) without the necessity of removing ratcheting head 26 from drive head H and re-engaging ratcheting head 26 with drive head H in a different orientation as would be required with a conventional open-ended wrench. If it is desired to turn drive head H in a counter-clockwise direction then it is only necessary to turn wrench 20 over.

The location of pivot axis 34 has a very significant effect on the operation of wrench 20. Pivot axis 34 should be located so that movable jaw 30 opens easily during back rotation, as described above.

Pivot axis 34 should also be located in a position wherein the forces on movable jaw 30 keep movable jaw 30 in its closed position when a drive head H is being tightened so that movable jaw 30 will turn the drive head H without slippage. This condition can be satisfied by placing pivot axis 34 in a position which is significantly forward from the locations of comparable pivot axes in most prior art wrenches.

Figure 8:
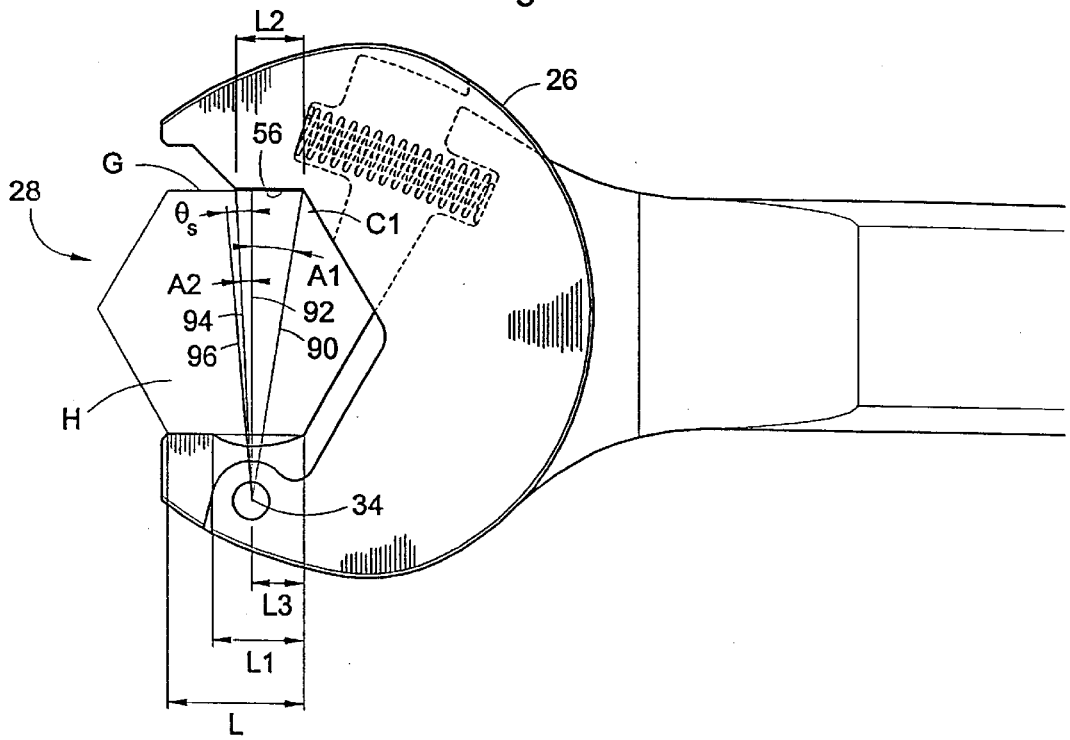
FIG. 8 is a side elevational view of a ratchet head according to the invention illustrating the location of a pivot point relative to the face of a drive head engaged by the ratcheting head.

For example, FIG. 8 shows a sharp cornered drive head H fully inserted in opening 28. An angle A1, may be measured as shown in FIG. 8, between a line 90 extending between corner C1 and pivot axis 34 and a second line 92 perpendicular to nut contacting surface 50. Angle A1 determines how firmly movable jaw 30 will be held closed during tightening of a drive head H which has sharp corners and is fully inserted into opening 28 (so that the innermost part of nut-contacting surface 56 grips face G of drive head H). Increasing angle A1 increases the force components which tend to hold movable jaw 30 closed during tightening. In the preferred embodiment of wrench 20, angle A1 is about 10°. Most preferably angle A1 is 8° or more.

Figure 9:
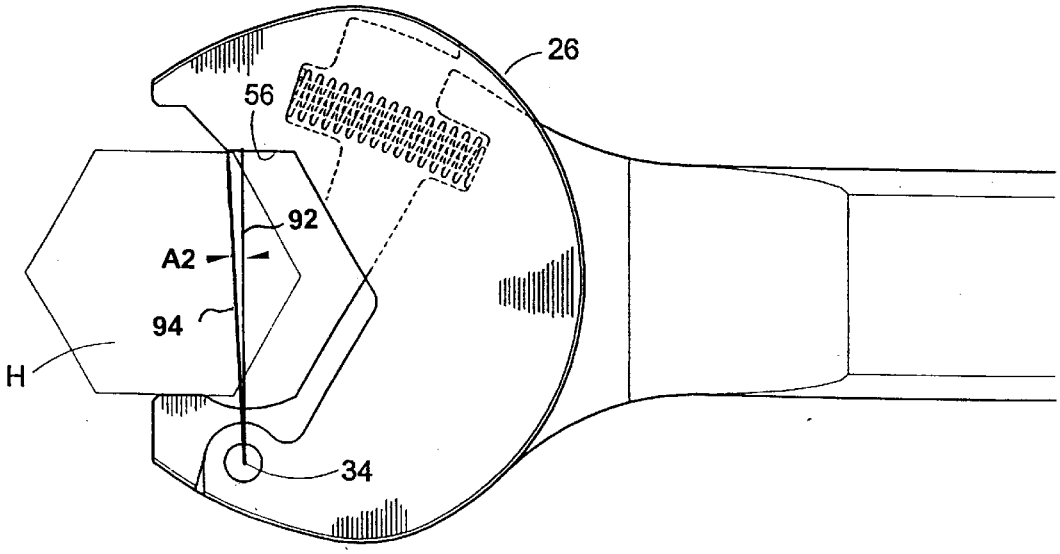
FIG. 9 is the view of FIG. 8 with the drive head partially withdrawn.

If drive head H has rounded corners or is not fully inserted into opening 28 or both then the innermost part of nut-contacting surface 56 cannot grip drive head H. In the worst case, as shown in FIG. 9, drive head H would be gripped only by the outermost end of nut-contacting surface 56. FIGS. 8 and 9 show an angle A2 measured between a line 94 joining the tip of nut contacting surface 56 and pivot axis 34 and the second line 92 (as defined above to be a line perpendicular to nut contacting surface 50). With line 92 as a reference, if positive angles are measured clockwise from line 92 then angle A2 is FIGS. 8 and 9 is a negative angle. That is, angle A2 measures a counterclockwise angular displacement of line 94 relative to line 92. When a drive head H is gripped only at the tip of movable jaw 30 then, if angle A2 is negative, as illustrated, the forces on movable jaw 30 tend to cause movable jaw 30 to open. Movable jaw 30 will begin to open under these circumstances if nut contacting surface 56 can slip on face G of drive head H.

Whether nut contacting surface 56 will slip on face G of drive head H depends upon whether the angle at which surface 56 applies forces to drive head H is greater or less than the angle of static friction $\theta_s$. $\theta_s$ is defined by the relationship:

$$\theta_s = \arctan(\mu) \quad (2)$$

Where $\mu$ is the static coefficient of friction between nut contacting surface 56 and face G of drive head H. Many textbooks state that $\theta_s$ for unlubricated steel surfaces commonly used to make wrenches and fastener drive heads is about −10 degrees. In practice wrenches must be considered to be lubricated because they are often coated with oils, greases or the like. The inventors' experiments have shown that $\theta_s$ is typically about −5 degrees for typical steel materials under various conditions of lubrication. At worst $\theta_s$ is about −3 degrees. FIG. 8 includes a line 96 which passes through pivot axis 34 at an angle of −3 degrees to second line 92. In FIG. 8 the angle of line 96 has been slightly exaggerated for clarity.

From the foregoing it can be seen that the end of nut contacting surface 56 should always be to the right of line 96 as shown in FIG. 8. This ensures that angle A2 will not be more negative than −3 degrees. Consequently surface 56 will not slip on face G even under worst case conditions. If drive head H engages a portion of nut contacting surface 56 further inside opening 28, as is desirable for best grip, surface 56 is even less likely to slip on face G. Under ideal conditions the point of contact between surface 56 and face G is at the innermost end of surface 56. It can be seen that the angle A1 between this point and pivot axis 34 is far to the right of line 96 so that slippage between nut contacting surface 56 and face G cannot occur.

It is possible to maintain angle A2 so that it is not more negative than −3° in a wrench 20 according to the preferred embodiment of this invention because pivot axis 34 is located relatively far forward relative to opening 28 as compared to most prior art wrenches. As shown in the accompanying drawings angle A2 can be made significantly more positive than −3° in a wrench 20 according to the invention. Many prior art wrenches do not have this feature and cannot be modified in any evident way to provide this feature. Such wrenches will slip on a drive head unless the drive head is fully engaged in the opening of the wrench.

It has been found that a smoother action on back rotation results if ratcheting head 26 can be counter rotated to a position where the outward end of nut-contacting surface 56 can slip easily on face G of drive head H before movable jaw 30 begins to open. To achieve this, an angle A3 between a line 98 (FIG. 6) perpendicular to face G and the line 94, which is defined above, should be significantly more negative than $\theta_s$. In the preferred embodiment of wrench 20 angle A3 is about −18 degrees.

If, as is the case in the embodiments illustrated herein, pivot axis 34 is located close to nut contacting surface 50 then the position of pivot axis 34 may be specified by the position at which line 92 through pivot axis 34 perpendicularly intersects the line defined by face F of a drive head positioned against nut-contacting surface 50. The inventors have determined that this intersection point should be located a distance L3 along nut-contacting surface 50 in the range of 0.3×L (about 0.17×D) to 0.5×L (about 0.289×D) as measured from corner C3 of a properly sized hexagonal drive head H fully engaged in opening 28. Pivot axis 34 is preferably located at a distance in the range of 0.35×L (about 0.2×D) to 0.45×L (about 0.26×D) along nut-contacting surface 50. Pivot axis 34 is most preferably located at a distance of about 0.39×L (about 0.22×D) along nut-contacting surface 50.

It can be appreciated that moving pivot axis 34 outwardly along nut-contacting surface 50 makes angle A2 less negative and results in wrench 20 being able to better grip a drive head H. Moving pivot axis 34 too far outwardly is not desirable, however, because angle A3, which affects the smoothness of back rotation, is made less negative as pivot axis 34 is moved outwardly. Further, if pivot axis 34 is too far outwardly then pivot pin 36 will be located in an undesirably narrow portion of fixed jaw 32. Conversely, if pivot axis 34 is located too far back toward handle 22 then ratcheting head 26 will become unable to properly grip a drive head H, especially if drive head H is not fully inserted into opening 28.

Figure 12:
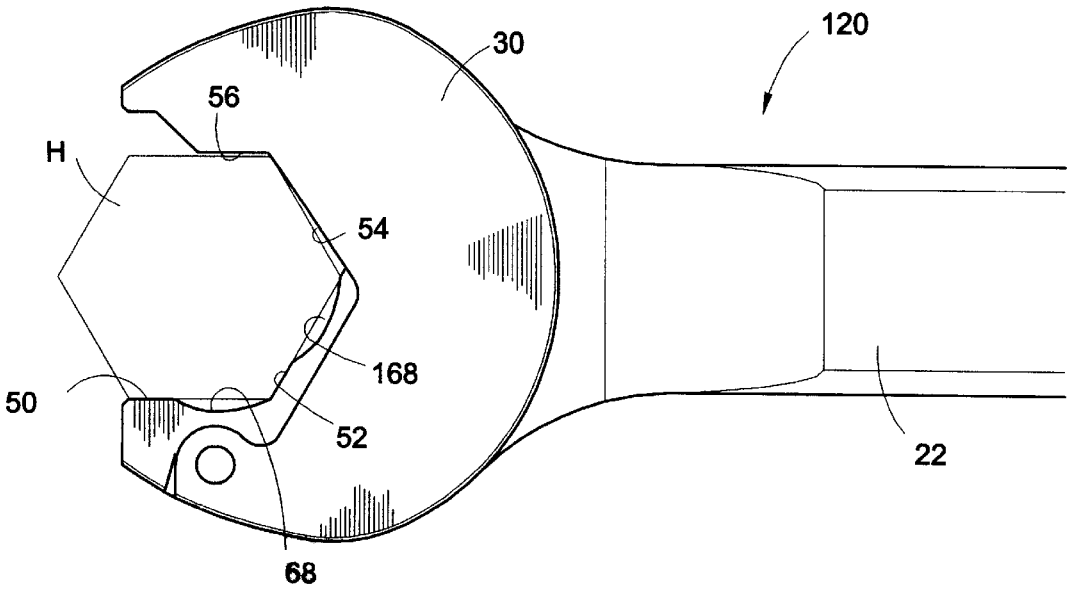
FIG. 12 is a side elevational view of the ratcheting head of a wrench according to an alternative embodiment of the invention wherein the backstop has a recessed portion and the movable jaw is relieved.

On wrenches according to the invention where angle A1 is small, it may be necessary to slightly relieve nut contacting surface 54, as shown, for example in FIG. 12, so that it does not contact drive head H when torque is being applied to drive head H. If nut-contacting surface 54 is maintained in tight contact with face G' of drive head H then face G' could press against nut-contacting surface 54 so as to open movable jaw 30. On wrenches where angle A1 is larger, nut contacting surface 54 can be allowed to bear against face G' to help to grip drive head H, in which case nut-contacting surface 54 may be termed a "third surface". In the preferred embodiment of wrench 20 it is not necessary for nut-contacting surface 54 to be relieved.

It can be appreciated that the wrench described herein is relatively simple to manufacture and has only four parts. Handle 22 and fixed jaw 32 may be fabricated as a single part. Movable jaw 30 is a second part. The remaining parts are pivot pin 36 and spring 42. As described below, it is possible to replace the pivot pin by appropriately shaping the movable jaw 30 and the fixed jaw 32. This reduces to three the number of parts needed to fabricate a wrench according to the invention.

FIG. 12 shows a wrench 120 according to an optional alternative embodiment of the invention. In wrench 120 an additional recess 168 is provided in nut-contacting surface 52. Recess 168 provides additional clearance to allow for back rotation of ratcheting head 26 relative to a hexagonal drive head H. A wrench according to the invention may have one or more recesses 68, 168. Providing an additional recess 168 in nut contacting surface 52 allows opening 28 of wrench 120 (FIG. 12) to rotate more nearly about the same axis as drive head H on back rotation than does opening 28 of wrench 20 of FIG. 1. Embodiments which include an additional recess 168 in nut contacting surface 52 can be designed so that corner C1 can push against nut-contacting surface 54 near the start of back rotation to swing pivoting jaw 30 towards its open position when drive head H is bottomed out against nut-contacting surface 52. This may result in a smoother action on back rotation. Of course, it is desirable that a wrench according to the invention can also be used to turn a drive head H which is not fully inserted into opening 28. Therefore, a wrench according to the invention should be designed bearing in mind the design considerations surrounding the angle of friction and angle A3 which are discussed above in relation to FIG. 6. It is not usually desirable to provide an additional recess 168 in a spanner type wrench, such as wrench 20 of FIG. 1 because an additional recess 168 tends to weaken stop member 60. As noted above, stop member 60 can be subjected to large loads. It is desirable to keep stop member 60 robust.

FIGS. 13, 14 and 15 depict a flare nut style wrench 220 according to an alternative embodiment of the invention. Wrench 220 operates generally as described above. In wrench 220, fixed jaw 32 is extended to provide an additional nut-contacting surface 250. Additional nut-contacting surface 250 may be called an "additional surface". Wrench 220 provides more contacting faces and therefore has a better grip on fasteners, than does the standard spanner type wrench 20 described above. Nut contacting surfaces 50 and 56 can be described respectively as first and second surfaces.

In addition to the recess 68 in nut contacting surface 50 wrench 220 has an additional recess 168 in backstop 52 and a second additional recess, or "second recessed portion" 268 in additional nut-contacting surface 250. The three recesses 68, 168 and 268 allow the ratcheting head of wrench 220 to counter rotate around a drive head H during back rotation as described above. Preferably each of recesses 68, 168 and 268 have a smooth arcuate contour. Preferably each of recesses 168 and 268 have a length approximately equal to the length of recess 68 as described above.

It can be appreciated that the forward position of pivot axis 34 helps to keep movable jaw 30 closed during tightening of a drive head. This permits nut-contacting surfaces 250, 50, 52, 54 and 56 to all help to grip and turn a drive head engaged in opening 28. Of course, not all of these surfaces have the same ability to drive a drive head H. As is the case in a standard wrench 20 (FIG. 4), nut contacting surfaces 50 and 56 have a greater capacity to drive drive head H than do nut contacting surfaces 52 or 54. In a wrench 220 additional nut contacting surface 250 is opposed to nut contacting surface 54 and therefore also has a reduced capacity as compared to nut contacting surfaces 50 and 56.

It can also be appreciated that a drive head H can be inserted into opening 28 by pushing the end of movable jaw 30 against the drive head until movable jaw 30 opens enough to slip over the drive head. This is in contrast to standard fixed flare nut wrenches which must be slid axially over a drive head. A flare nut type wrench 220 according to the invention may be made very compact.

While it is not necessary, a wrench according to the invention may be readily made to have all of its nut contacting surfaces equal in width. In particular, stop member 59 is configured so that nut contacting surface 52 can be made just as wide as the other nut-contacting surfaces. This is advantageous because it provides a larger area of contact between the various nut contacting surfaces and a drive head than would be the case if some nut contacting surfaces were much narrower than others. Furthermore, when a wrench has nut contacting surfaces 50, 52 and 56 which are equal in width, as illustrated by the preferred embodiments 20, 220 of FIGS. 1 and 13 respectively, then the wrench will work, as described above, even if the drive head H being turned is very thin or if the drive head H is gripped with the edges of the nut contacting surfaces only. In preferred embodiments of the invention, therefore, nut-contacting surfaces 50, 52 and 56 are all equal in width. Most preferably, all nut-contacting surfaces in a wrench according to the invention are equal in width. Some prior art wrench designs do not provide nut-contacting surfaces which are equal in width.

Figure 10:
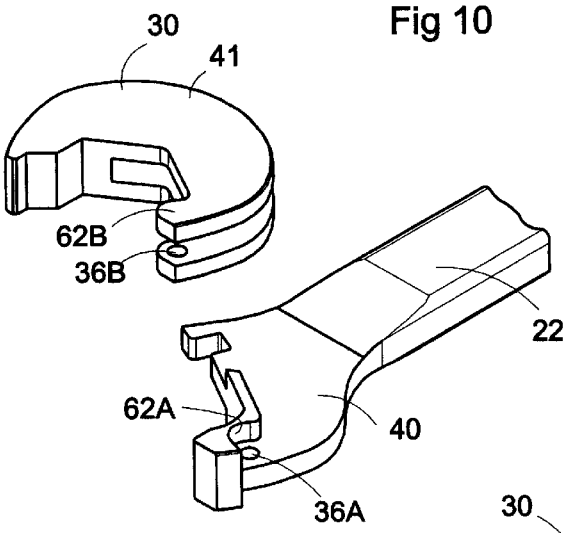
FIG. 10 is an exploded isometric view of a wrench according to an alternative embodiment of the invention wherein a movable jaw pivots about an axis defined by mating dimples and protrusions.
Figure 11:
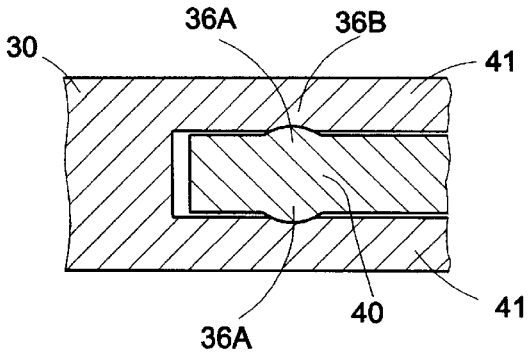
FIG. 11 is a partial sectional view through the ratcheting head of the wrench of FIG. 10, when assembled.

As will be apparent to those skilled in the art in the light of the foregoing disclosure, many alterations and modifications are possible in the practice of this invention without departing from the spirit or scope thereof. For example, pivot pin 36 could be replaced with some other means for pivotally fastening movable jaw 30 to fixed jaw 32. One way to do this is to provide opposed projections 36A on either side of web 40 and to provide corresponding dimples, recesses or holes 36B on the inward faces of side plates 41 as shown in FIGS. 10 and 11. Movable jaw 30 could then be assembled to fixed jaw 32 by spreading side plates 41, positioning dimples 36B over projections 36A and allowing projections 36A to snap into dimples 36B. This arrangement will still be strong enough to work reliably because most of the forces acting between fixed jaw 32 and movable jaw 30 are transmitted directly between faces 62B and faces 62A as described above. In the alternative to having dimples 36B in side plates 41 and projections 36A in web 40, dimples 36B could be in web 40 and projections 36A could be on side plates 41.

In cases where it is not necessary to provide a wrench which conforms with SAE specifications, a wrench according to the invention could be made with a pin 36 large enough to transmit all of the forces generated during use between movable jaw 30 and fixed jaw 32. By rotating head 26 relative to handle 22 the pin could be located in a strong part of the handle. In this case mating bearing faces 62B and 62A would not be necessary.

Other bias means may be provided in place of spring 42 to cause movable jaw 30 to pivot toward its closed position. For example, a leaf spring, a resilient bumper, a differently arranged compression spring or a tension spring could be used in place of compression spring 42.

Instead of being equipped with a long handle 22 as shown in the drawings head 26 could be attached to a very short handle equipped with a socket to provide a ratcheting crow-foot type wrench.

Movable jaw 30 has been illustrated and described as being of sufficient length that nut-contacting surface 56 extends half way along the flat G of head H when head H is fully inserted into opening 28. That is, nut-contacting surface 56 has a length of approximately 0.5×L (or 0.3×D). Nut-contacting surface 56 could be made somewhat shorter than this. However, if nut-contacting surface 56 is too short then it will no longer adequately grip a drive head H if the corners of drive head H are rounded. Nut-contacting surface 56 could be made slightly longer than this. However, if it is too long then drive head H may become jammed during back-rotation.

Recesses 68, 168, and 268 have been illustrated and described as being arc-shaped. The shape and depths of recesses 68, 168 and 268 could be varied without affecting the operation of a wrench according to the invention as long as they allow sufficient back rotation of ratcheting head 26 relative to a drive head H and do not catch the corners of the drive head H as it turns.

Accordingly, the scope of the invention is to be construed in accordance with the substance defined by the following claims.

We claim:

1. A ratcheting wrench for turning a hexagonal drive head, such as the head of a fastener, the wrench comprising:

a) a handle having first and second ends;

b) a fixed jaw projecting forwardly from the first end of the handle;

c) a movable jaw pivotally attached to the handle, the movable jaw pivotally movable relative to the fixed jaw about a pivot axis, the fixed and movable jaws defining between themselves an opening for receiving a hexagonal drive head between first and second surfaces on the fixed and movable jaws respectively, the first and second surfaces being generally parallel when the movable jaw is in a first position;

d) a stop member on the fixed jaw, a rearward face on the stop member providing an elongated stop surface located to block the movable jaw from pivoting past the first position toward the fixed jaw, a forward face on the stop member providing a backstop for blocking a drive head from being inserted into the opening past the backstop; and, e) bias means disposed between the handle and the movable jaw for biasing the movable jaw toward the fixed jaw;

wherein the first and second surfaces are spaced apart by a distance D when the movable jaw is in the first position and the pivot axis is located on a side of the first surface away from the second surface and is located forwardly of a rear edge of the first surface by a distance of at least 0.17×D.

2. The ratcheting wrench of claim 1 wherein the fixed jaw has a recessed portion, recessed relative to the first surface, between the first surface and the backstop.

3. The ratcheting wrench of claim 2 wherein the recessed portion extends from the backstop for a distance of at least 0.35×D.

4. The ratcheting wrench of claim 3 wherein the recessed portion has a concave arcuate contour.

5. The ratcheting wrench of claim 2 wherein the movable jaw comprises a pair of side plates separated by a slot and the slot receives a web portion connecting the handle and the fixed jaw.

6. The ratcheting wrench of claim 5 wherein the stop comprises a member projecting outwardly on either side of the web and forward surfaces of the side plates bear against the stop when the movable jaw is in its first position.

7. The ratcheting wrench of claim 6 wherein the bias means comprises a compression spring located between the handle and the second jaw.

8. The ratcheting wrench of claim 7 wherein the compression spring is located within the slot between the side plates and has a first end received in a recess in the movable jaw and a second end engaged in a recess in the first end of the handle.

9. The ratcheting wrench of claim 8 wherein the recesses are angled relative to one another and the spring extends in an arc between the recesses.

10. The ratcheting wrench of claim 9 wherein the movable jaw comprises a shutter portion blocking a distal portion of the slot.

11. The ratcheting wrench of claim 5 wherein the movable jaw comprises an arcuate surface portion following an arc centred on the pivot axis and the fixed jaw comprises a bearing surface which bearingly receives the arcuate surface portion.

12. The ratcheting wrench of claim 11 wherein there are two arcuate surface portions, each arcuate surface portion located on an ear portion projecting from a different one of the side plates, each arcuate surface portion bearingly received by a correspondingly shaped bearing surface on the fixed jaw.

13. The ratcheting wrench of claim 12 wherein the second surface has a length of approximately 0.3×D.

14. The ratcheting wrench of claim 13 wherein the backstop comprises an elongated surface extending smoothly between a mid-point of the opening and the recessed portion, the elongated surface disposed at an angle of 60 degrees to the first surface.

15. The ratcheting wrench of claim 14 wherein the movable jaw comprises an outwardly extending angled surface for guiding a drive head into the opening.

16. The ratcheting wrench of claim 12 wherein the first surface is generally parallel to a longitudinal axis of the handle to provide for inline insertion of a drive head into the opening.

17. The ratcheting wrench of claim 5 wherein the pivot axis is defined by a pivot pin passing through the side plates and the web.

18. The ratcheting wrench of claim 5 wherein the pivot axis is defined by either a pair of opposed indentations in the web, the opposed indentations receiving corresponding projections from the side plates or a pair of opposed projections projecting outwardly from the web, the opposed projections received in corresponding indentations in the side plates.

19. The ratcheting wrench of claim 2 wherein the first surface is generally parallel to a longitudinal axis of the handle to provide for inline insertion of a drive head into the opening.

20. The ratcheting wrench of claim 1 wherein the movable jaw comprises an arcuate surface portion following an arc centred on the pivot axis and the fixed jaw comprises a bearing surface which bearingly receives the arcuate surface portion.

21. The ratcheting wrench of claim 2 wherein the second surface has a length of approximately 0.3×D.

22. The ratcheting wrench of claim 13 wherein the backstop comprises an elongated surface extending smoothly between a mid-point of the opening and the recessed portion, the elongated surface disposed at an angle of 60 degrees to the first surface.

23. The ratcheting wrench of claim 22 wherein the stop surface and the backstop are substantially coextensive.

24. The ratcheting wrench of claim 1 wherein the movable jaw comprises an outwardly extending angled surface for guiding a drive head into the opening.

25. The ratcheting wrench of claim 2 adapted to be a flare-nut style wrench wherein the fixed jaw comprises an extension projecting outwardly from the outer end of the first surface, the extension bearing an additional surface inclined at an angle of 60 degrees to the first surface and a second recessed portion between the first and additional surfaces, wherein a portion of the backstop is recessed to permit back-rotation of a drive head in the opening.

26. The ratcheting wrench of claim 25 wherein the backstop comprises a flat surface adjacent the second recessed portion, the flat surface disposed at an angle of 60 degrees to the first surface.

27. The ratcheting wrench of claim 26 wherein the stop surface and the backstop are substantially coextensive.

28. The ratcheting wrench of claim 2 wherein the movable jaw comprises a third surface oriented at an angle of 60 degrees to the second surface.

29. The ratcheting wrench of claim 2 wherein the pivot axis is located forwardly of a rear edge of the first surface by a distance in the range of 0.2×D to 0.26×D.

30. The ratcheting wrench of claim 6 wherein the first and second surfaces and the backstop are all equal in width.

31. A ratcheting wrench comprising:

(a) a handle;

(b) a fixed jaw on the handle;

(c) a movable jaw pivotally mounted to the handle for pivotal motion about a pivot axis between a closed position and an open position, the movable and fixed jaws defining between themselves an opening for receiving a hexagonal drive head, the opening formed by:

(1) a first surface and a backstop surface on the fixed jaw;

(2) a second surface on the movable jaw, the second surface opposed to the first surface and on an opposite side of the opening from the pivot axis; and, (3) a recessed portion in the fixed jaw between the first surface and the backstop surface; and, (d) a spring biasing the movable jaw toward its closed position; wherein, when a hexagonal drive head having six flats is engaged in the opening with three flats in a statically determined three point contact with the first and second surfaces and the backstop, then a first line extending between the pivot axis and an outer end of the second surface forms an angle A2 with a second line which is perpendicular to the flat of the hexagonal drive head in contact with the first surface and angle A2 is less negative than −5 degrees.

32. The ratchet wrench of claim 31 wherein the first and second surfaces are generally flat and the second line is generally perpendicular to the first surface.

33. The ratchet wrench of claim 31 wherein the first and second surfaces are spaced apart by a distance D when the movable jaw is in its closed position and the recessed portion has a length of at least 0.35×D.

34. The ratchet wrench of claim 31 wherein the recessed portion is arcuate.

35. The ratchet wrench of claim 34 wherein when a hexagonal drive head having opposed flats of length L and spaced apart by a distance equal to D is fully engaged in the opening then the outermost end of the second surface is at a midpoint of the flat which is adjacent the second surface.

36. The ratchet wrench of claim 31 wherein an angle A1 between a line connecting the pivot axis and an innermost point on the second surface and a line parallel to the second line and extending through the innermost point on the second surface is 8 degrees or more.

37. The ratchet wrench of claim 31 wherein the first and second surfaces and the backstop surface are all equal in width.

* * * * *